United States Patent [19]

Beach et al.

[11] 4,381,414

[45] Apr. 26, 1983

[54] FUEL HAVING REDUCED TENDENCY TO PARTICULATE DISSEMINATION UNDER SHOCK

[75] Inventors: David L. Beach, Gibsonia; Charles M. Selwitz, Monroeville, both of Pa.

[73] Assignee: Gulf Research & Development Company, Pittsburgh, Pa.

[21] Appl. No.: 261,256

[22] Filed: May 6, 1981

[51] Int. Cl.[3] ..... C10L 1/04

[52] U.S. Cl. ..... 585/10; 44/62; 585/14

[58] Field of Search ..... 585/10, 14; 44/62

[56] References Cited

U.S. PATENT DOCUMENTS

| | | | |
|---|---|---|---|
| 3,923,473 | 12/1975 | Sandy | 44/62 |
| 3,996,023 | 12/1976 | Osmond et al. | 585/10 |
| 4,151,216 | 4/1979 | Smith | 585/14 |

*Primary Examiner*—Jacqueline V. Howard

*Attorney, Agent, or Firm*—Deane E. Keith; Forrest D. Stine; Joseph J. Carducci

[57] ABSTRACT

A fuel having reduced tendency to particulate dissemination under shock comprising a liquid hydrocarbon jet aviation fuel of flash point at least 90° F. (32.2° C.) containing dissolved atactic polypropylene.

5 Claims, No Drawings

FUEL HAVING REDUCED TENDENCY TO PARTICULATE DISSEMINATION UNDER SHOCK

BACKGROUND OF THE INVENTION

1. Field of the Invention

This invention relates to a fuel having reduced tendency to particulate dissemination under shock comprising a liquid hydrocarbon jet aviation fuel of flash point at least 90° F. (32.2° C.) containing dissolved atactic polypropylene.

2. Description of the Prior Art

It is known that when liquid hydrocarbon jet aviation fuels are subjected to conditions of shock, for example, in a crash of a jet aircraft with subsequent rupture of its fuel tanks, the fuel has a tendency to particulate dissemination into mists which can be readily ignited by flames, electric sparks, hot metal, etc., resulting in major hazard to all personnel in the immediate area.

Many efforts have been made in the past to reduce such hazard by incorporating in the fuel additives that have a tendency to reduce particulate dissemination. Thus, in U.S. Pat. No. 3,996,023 to Osmond et al (I), the additives employed are non-crystalline polymers devoid of polar groups, such as polymers derived from ethylenically unsaturated hydrocarbons, including isobutylene, butadiene, isoprene, mixtures of ethylene and propylene containing from 10 to 80 weight percent propylene, preferably from 18 to 25 weight percent of propylene, and alkylated polystyrenes. In U.S. Pat. No. 3,998,605 Osmond et al (II) empoys as additive a copolymer of ethylene with a higher olefin, preferably propylene, which contains not more than 95 percent, preferably not more than 85 percent, by weight of ethylene and has a molecular structure comprising at least two, preferably at least 10, runs of at least 10, preferably at least 20, units of ethylene separated by runs of hydrocarbon-soluble polymer which may be a random copolymer of ethylene and higher olefin or a homopolymer of the higher olefin. In U.S. Pat. No. 4,002,426 Osmond et al (III) have found that additives similar to those defined in their U.S. Pat. No. 3,996,023, referred to above, can also be used but wherein the polymers contain polar groups which form inter-molecular associative bonds with each other when the liquid is subjected to shear, such as nitrile, nitro, sulfone, aromatic residues substituted with these groups and ion pairs.

SUMMARY OF THE INVENTION

We have found that liquid hydrocarbon jet aviation fuels of flash point at least 90° F. (32.2° C.) will have reduced tendency to particulate dissemination, with resultant reduced tendency to form mists, by the relatively simple expedient of incorporating therein a selected amount of atactic polypropylene.

BRIEF DESCRIPTION OF THE INVENTION

The liquid hydrocarbon jet aviation fuel suitable for use in a gas turbine engine that is improved herein is one having a flash point (ASTM D-93) at least 90° F., for example, Grade JP-8, Grade JP-5, Grades Jet A and Jet A-1, Grade Jet B, etc., as defined, for example, in the above patents to Osmond et al. The additive incorporated into the liquid hydrocarbon jet aviation fuel, resulting in a novel composition of matter claimed herein, is a selected polypropylene which is predominantly atactic. By "atactic polypropylene" we mean to include an amorphous polypropylene substantially soluble in a liquid hydrocarbon jet aviation fuel carrying methyl groups randomly disposed spatially along its backbone, with an average of about one methyl group for each two carbon atoms on said backbone, having an intrinsic viscosity (in tetralin at 130° C.) of at least about three deciliters per gram, preferably about six to about 26 deciliters per gram. The atactic polypropylene used herein can be obtained in any conventional or convenient manner, for example, by contacting propylene in a solution containing vanadium tetrachloride and triethylaluminum. Representative procedures are disclosed, for example in Ziegler Natta Catalysts and Polymerizations, John Boor, Jr., Academic Press, Inc., 111 Fifth Avenue, New York, N.Y., 1979, pages 61 to 67.

The amount of such atactic polypropylene that is dissolved in the liquid hydrocarbon jet aviation fuel to obtain the novel fuel herein having a reduced tendency to particulate dissemination can be in the range of about 0.01 to about two weight percent, preferably about 0.05 to about one weight percent, most preferably about 0.1 to about 0.5 weight percent, based on the treated fuel. The novel fuel herein is easily prepared, for example, by merely introducing the atactic polypropylene into the liquid hydrocarbon jet aviation fuel and stirring for a time sufficient to dissolve the atactic polypropylene into the liquid hydrocarbon jet aviation fuel, or by a cyrogenic blending technique, such as described in European patent application No. 80300506.5, published Mar. 9, 1980, of William Weltzen and assigned to General Technology Applications, Inc. For example, at ambient conditions of temperature and pressure solution can be effected in a period of about one to about 24 hours.

DESCRIPTION OF PREFERRED EMBODIMENTS

A series of runs was carried out exemplifying the novel fuel claimed herein.

EXAMPLE I

Four hundred milliliters of anhydrous toluene were cooled to −78° C. in a glass reactor under a nitrogen atmosphere with a dry ice/isopropanol bath. Propylene was bubbled through the toluene at atmospheric pressure until 200 milliliters had condensed into the solution. Vanadium tetrachloride (0.2 milliliter) and triethylaluminum (10 milliliters) of a 25 weight percent solution in n-heptane were added, and the polymerization reaction was allowed to proceed for almost two hours. The solid atactic polypropylene polymer was washed several times with about 200-milliliter portions of isopropanol acidified with HCl and filtered and air dried. The polymer is identified herein as Propylene Polymer A.

EXAMPLE II

One hundred milliliters of anhydrous toluene were cooled to −78° C. in a glass reactor under a nitrogen atmosphere with a dry ice/isopropanol bath. Propylene was bubbled through the toluene at atmospheric pressure until 50 milliliters had condensed into the solution. A solution of 0.03 milliliters of vanadium tetrachloride in five milliliters of dry n-heptane was syringed into the reactor, immediately followed by five milliliters of a 25 weight percent solution of triethylaluminum in n-heptane. The polymerization reaction was allowed to proceed for two hours, after which it was quenched with isopropanol and the resulting atactic polypropylene polymer was recovered as in the preceding operation described in Example I. The polymer is identified herein as Propylene Polymer B.

EXAMPLE III

Into a glass reactor there were charged two liters of dry, oxygen-free cyclohexane, 1.22 grams of titanium trichloride and 0.68 milliliter of triethylaluminum. The resulting slurry was heated to 60° C. with stirring and 200 milliliters of dry oxygen- and peroxide-free 1-tetradecene added. The polymerization reaction was allowed to proceed for 45 hours and monitored by following the decrease in concentration of 1-tetradecene by gas chromatographic analysis of samples taken at appropriate levels. The reaction was quenched by adding 25 milliliters of isopropyl alcohol to the reaction product. The reaction product was added, with vigorous stirring, to three liters of isopropyl alcohol containing 0.03 gram of 2,6-di-ti-butyl-p-cresol. The resulting polymer, poly(1-tetradecene), was isolated and washed consecutively with two two-liter portions of isopropyl alcohol and then dried in-vacuuo at 55° C.

EXAMPLE IV

Poly (1-octadene) was prepared following the procedure of Example III, except that 314.4 grams of 1-octadecene were used in place of 1-tetradecene and 2.90 grams of titanium trichloride and 1.09 grams of triethylaluminum were used.

EXAMPLE V

Poly($C_{20-24}$) was prepared following the procedure of Example III, except that 171.1 grams of a $C_{20-24}$ alpha olefin mixture were used in place of 1-tetradecene and the amount of triethylaluminum was 1.85 grams.

EXAMPLE VI

A number of runs was carried out wherein each of the polymeric materials produced in Examples I to V was incorporated into a liquid hydrocarbon jet aviation fuel and the resulting fuel was tested for its tendency to particulate dissemination under shock. The base fuel analyzed as follows:

TABLE I

| | |
|---|---|
| Gravity, ASTM D287: API | 42.9 |
| Viscosity, Kinematic: Cs | |
| −40° F. (−40° C.) | 13.2 |
| −30° F. (−34° C.) | 9.99 |
| 0° F. (−18° C.) | 5.47 |

TABLE I-continued

| | |
|---|---|
| 100° F. (38° C.) | 1.57 |
| 210° F. (99° C.) | 0.77 |
| Flash, TCC, ASTM D56: °F. (°C.) | 141 (61) |
| Freezing Point, ASTM D2386: °F. (° C.) | −47 (−44) |
| Color, Saybolt | +30 |
| Doctor, FTMS 791-5203 | Negative |
| Sulfur, ASTM D1266: % | 0.01 |
| Copper Strip, ASTM D130, 212° F. (100° C.), 3 hours | 1 |
| Total Acidity, ASTM D974 Mod: MgKOH/Gm | <0.001 |
| Existent Gum, ASTM D381: Mg/100 Ml | <1 |
| Potential Gum, ASTM D873, 16 Hours: Mg/100 Ml | 1 |
| Naphthalenes, ASTM D1805: % V | 1.52 |
| Hydrocarbon Types, ASTM D1319 | |
| Aromatics: % V | 16.5 |
| Olefins: % V | 0.5 |
| Saturates, By Difference | 83.0 |
| Thermal Stability, ASTM D1660 | |
| Pressure Drop, Five Hours: In Hg | 0.1 |
| Preheater Deposit: Rating | 0 |
| Water Reaction, FTMS 791-3251 | |
| Change in Vol: Ml | 0 |
| Interface Rating | 1 & 1 |
| Water Separation Index Mod, ASTM D2550 | 97 |
| Smoke Point, ASTM D1322: Mm | 24 |
| Distillation, ASTM D86 | |
| Over Point: °F. (°C.) | 340 (171) |
| End Point: °F. (°C.) | 515 (268) |
| 10% Evaporated: °F. (°C.) | 386 (197) |
| 20% Evaporated: °F. (°C.) | 396 (202) |
| 50% Evaporated: °F. (°C.) | 420 (216) |
| 90% Evaporated: °F. (°C.) | 456 (236) |
| 95% Evaporated: °F. (°C.) | 464 (240) |
| Recovery: Percent | 99.0 |
| Residue: Percent | 1.0 |
| Loss: Percent | 0 |

The test was carried out as follows. At atmospheric pressure air was continuously passed longitudinally through an air delivery pipe having an inner diameter of one inch (2.54 centimeters). At a rate varying from about 10 to about 18 milliliters per second, the treated fuel was dropped into the flowing air stream using a tube having an inner diameter of ¼-inch (0.64 centimeter) inserted in the wall of the delivery pipe. A diffuser cone six inches in diameter (15.24 centimeters) was attached to the end of the delivery pipe six inches from fuel line. At the end of the diffuser cone and in the center of the air-fuel flow there was mounted a propane torch with its flame pointed in the direction of said flow. In each of the runs observation was made of the nature of the flame resulting from the ignition of the fuel. The results obtained are tabulated below in Table II.

TABLE II

| Run No. | Additive | Intrinsic Viscosity, dl/gm | −40° C. | 18° C. | 38° C. | 99° C. | Concentration Weight Percent | Air Velocity, Meters Per Second | Fuel Flow, Milliliters Per Second | Results |
|---|---|---|---|---|---|---|---|---|---|---|
| 1 | Propylene Polymer A | 2.896 | 62.16 | 24.79 | 7.13 | 3.15 | 1.0 | 55 | 14 | Pass |
| 2 | " | " | " | " | " | " | " | " | 18 | Pass |
| 3 | " | " | " | " | " | " | " | 70 | " | Pass |
| 4 | " | " | " | " | " | " | " | 82 | " | Pass |
| 5 | " | " | " | " | " | " | 0.5 | 55 | 10 | Pass |
| 6 | " | " | " | " | " | " | " | " | 14 | Pass |
| 7 | " | " | " | " | " | " | " | " | 18 | Pass |
| 8 | " | " | " | " | " | " | " | 65 | " | Marginal |
| 9 | " | " | " | " | " | " | " | 70 | 14 | Pass |
| 10 | " | " | " | " | " | " | " | " | 18 | Pass |
| 11 | " | " | " | " | " | " | " | 75 | " | Pass |
| 12 | " | " | " | " | " | " | 0.3 | 45 | 10 | Pass |
| 13 | " | " | " | " | " | " | " | " | 12 | Pass |
| 14 | " | " | " | " | " | " | " | " | 14 | Marginal |
| 15 | " | " | " | " | " | " | " | " | 16 | Marginal |
| 16 | " | " | " | " | " | " | " | " | 18 | Fail |
| 17 | " | " | " | " | " | " | " | 55 | 10 | Pass |

TABLE II-continued

| Run No. | Additive | Intrinsic Viscosity, dl/gm | −40° C. | 18° C. | 38° C. | 99° C. | Concentration Weight Percent | Air Velocity, Meters Per Second | Fuel Flow, Milliliters Per Second | Results |
|---|---|---|---|---|---|---|---|---|---|---|
| 18 | " | " | " | " | " | " | " | " | 12 | Pass |
| 19 | " | " | " | " | " | " | " | " | 14 | Pass |
| 20 | " | " | " | " | " | " | " | " | 16 | Fail |
| 21 | " | " | " | " | " | " | " | " | 18 | Fail |
| 22 | " | " | " | " | " | " | " | 50 | " | Fail |
| 23 | " | " | " | " | " | " | " | " | 16 | Fail |
| 24 | " | " | " | " | " | " | " | " | 14 | Fail |
| 25 | " | " | " | " | " | " | " | 65 | 10 | Pass |
| 26 | " | " | " | " | " | " | " | " | 12 | Pass |
| 27 | " | " | " | " | " | " | " | " | 14 | Pass |
| 28 | " | " | " | " | " | " | " | " | 16 | Pass |
| 29 | " | " | " | " | " | " | " | " | 18 | Fail |
| 30 | " | " | " | " | " | " | " | 75 | 10 | Pass |
| 31 | " | " | " | " | " | " | " | " | 12 | Pass |
| 32 | " | " | " | " | " | " | " | " | 14 | Marginal |
| 33 | " | " | " | " | " | " | " | " | 16 | Marginal |
| 34 | " | " | " | " | " | " | " | " | 16 | Marginal |
| 35 | " | " | " | " | " | " | " | " | 18 | Marginal |
| 36 | Propylene Polymer B | 9.094 | 55.33 | 22.41 | 6.20 | 2.75 | 1.0 | 40 | 14 | Pass |
| 37 | " | " | " | " | " | " | " | 55 | " | Pass |
| 38 | " | " | " | " | " | " | " | 70 | 18 | Pass |
| 39 | Poly(1-tetradecene) | 2.099 | — | — | — | — | " | 55 | 14 | Pass |
| 40 | " | " | — | — | — | — | " | " | 18 | Fail |
| 41 | " | " | — | — | — | — | " | 70 | 18 | Fail |
| 42 | Poly(1-octadecene) | 1.479 | — | — | — | — | " | 55 | 14 | Fail |
| 43 | Poly($C_{20}$-$C_{24}$) | 0.805 | — | — | — | — | " | " | " | Fail |

In the above table "pass" means that the fuel did not tend to particulate dissemination, since the flame did not propogate beyond the flame point of the propane torch. The remainder of the air-fuel mixture, therefore, did not ignite. "Marginal" means that the flame propagated only from about one to about ten inches along the longitudinal flow path of the air-fuel mixture. By "fail" we mean that substantially all of the fuel ignited into and beyond the cone area.

Tests similar to the above were also carried out with a base fuel having the same analysis as that described in Table I but with no additive. The results obtained are set forth below in Table III.

TABLE III

| Air Velocity, Meters Per Second | Fuel Flow, Milliliters Per Second | | | | | | | |
|---|---|---|---|---|---|---|---|---|
| | 40 | 45 | 50 | 55 | 60 | 65 | 70 | 75 |
| 10 | Fail | Fail | Fail | Fail | Fail | Fail | Fail | Fail |
| 12 | " | " | " | " | " | " | " | " |
| 14 | " | " | " | " | " | " | " | " |
| 16 | " | " | " | " | " | " | " | " |
| 18* | " | " | " | " | " | " | " | " |

*Did not carry out the series of runs; assume these would also fail, since they are more severe than preceding runs.

It can be seen from Table II that the base fuel alone either failed, or would be expected to fail, when subjected to the specified conditions of shock. It can further be seen from the data in Table II that when the base fuel contained selected amounts of atactic polypropylene, its tendency to particulate dissemination under similar, or comparable, conditions of shock was greatly diminished.

Obviously, many modifications and variations of the invention, as hereinabove set forth, can be made without departing from the spirit and scope thereof, and therefore only such limitations should be imposed as are indicated in the appended claims.

We claim:

1. A fuel having reduced tendency to particulate dissemination under shock comprising a liquid hydrocarbon jet aviation fuel of flash point at least 90° F. containing dissolved atactic polypropylene carrying methyl groups randomly disposed spatially along its backbone, with an average of about one methyl group for each two carbon atoms on said backbone, and having an intrinsic viscosity of at least about three deciliters per gram.

2. The fuel composition of claim 1 wherein the amount of said atactic polypropylene dissolved therein is about 0.01 to about two weight percent.

3. The fuel composition of claim 1 wherein the amount of said atactic polypropylene dissolved therein is about 0.05 to about one weight percent.

4. The fuel composition of claim 1 wherein the amount of said atactic polypropylene dissolved therein is about 0.1 to about 0.5 weight percent.

5. The fuel composition of claim 1 wherein the intrinsic viscosity of said atactic polypropylene is from about six to about 26 deciliters per gram.

* * * * *